United States Patent [19]

Hyeong-Woon

[11] Patent Number: 4,539,749

[45] Date of Patent: Sep. 10, 1985

[54] PORTABLE KNIFE EQUIPPED WITH A SPOON AND A FORK

[76] Inventor: Shin Hyeong-Woon, 10-25, Bougcheon 3-Dong, Kwanak-ku, Seoul, Rep. of Korea

[21] Appl. No.: 589,424

[22] Filed: Mar. 14, 1984

[30] Foreign Application Priority Data

Aug. 17, 1983 [KR] Rep. of Korea ..... 7213/1983

[51] Int. Cl.[3] ..... B26B 1/02; B26B 1/08

[52] U.S. Cl. ..... 30/147; 7/118; 30/162; 30/344

[58] Field of Search ..... 30/142, 143, 144, 147, 30/148, 150, 344, 162; 7/167, 118; 145/61 C

[56] References Cited

U.S. PATENT DOCUMENTS

| | | | |
|---|---|---|---|
| 309,863 | 12/1884 | McGovern | 7/118 X |
| 472,104 | 4/1892 | Bultzingslowen | 7/118 X |
| 1,187,842 | 6/1916 | Kaas | 30/144 X |
| 1,282,875 | 10/1918 | Kupec | 30/147 X |
| 1,980,087 | 11/1934 | Rast | 30/344 X |
| 2,213,071 | 8/1940 | Keller | 30/344 X |
| 2,456,858 | 12/1948 | Bolling | 30/147 X |
| 2,591,655 | 4/1952 | Foley | 7/118 |
| 4,030,194 | 6/1977 | Hendricks | 30/162 |

*Primary Examiner*—Jimmy C. Peters
*Attorney, Agent, or Firm*—Jones, Tullar & Cooper

[57] ABSTRACT

A portable knife including a knife and at least one utensile. The portable knife comprises an assembly of elongated plates at least one of which defines a longitudinally extending pocket having an open end which receives and retains an elongated portion of the utensile. The plate that defines the pocket is displaceable at at least one side at its open end transversely of the assembly to permit receiving and removing the utensile.

6 Claims, 3 Drawing Figures

PORTABLE KNIFE EQUIPPED WITH A SPOON AND A FORK

BACKGROUND OF THE INVENTION

This invention is related to a multiple-purpose portable knife not only equipped with a can opener and a bottle opener but also combined with a spoon and a fork.

Although such a multiple-purpose portable knife combined with a spoon or a fork has been in use, it has a spoon and a fork axially installed on its axle. So a spoon or a fork must be respectively attached to either side of the exterior part of the knife's grip.

For use, the spoon and the fork must be stretched in the opposite directions.

Such a conventional portable knife is, when folded, not only bulky but also unwieldy because spoon and fork are folded on both sides of the grip.

SUMMARY OF THE INVENTION

However, this invention is designed to enable the spoon or the fork to be easily combined with or separated from the portable knife, to make it handy to carry and beautiful when the spoon and the fork are combined.

DETAILED DESCRIPTION

Figure 1:
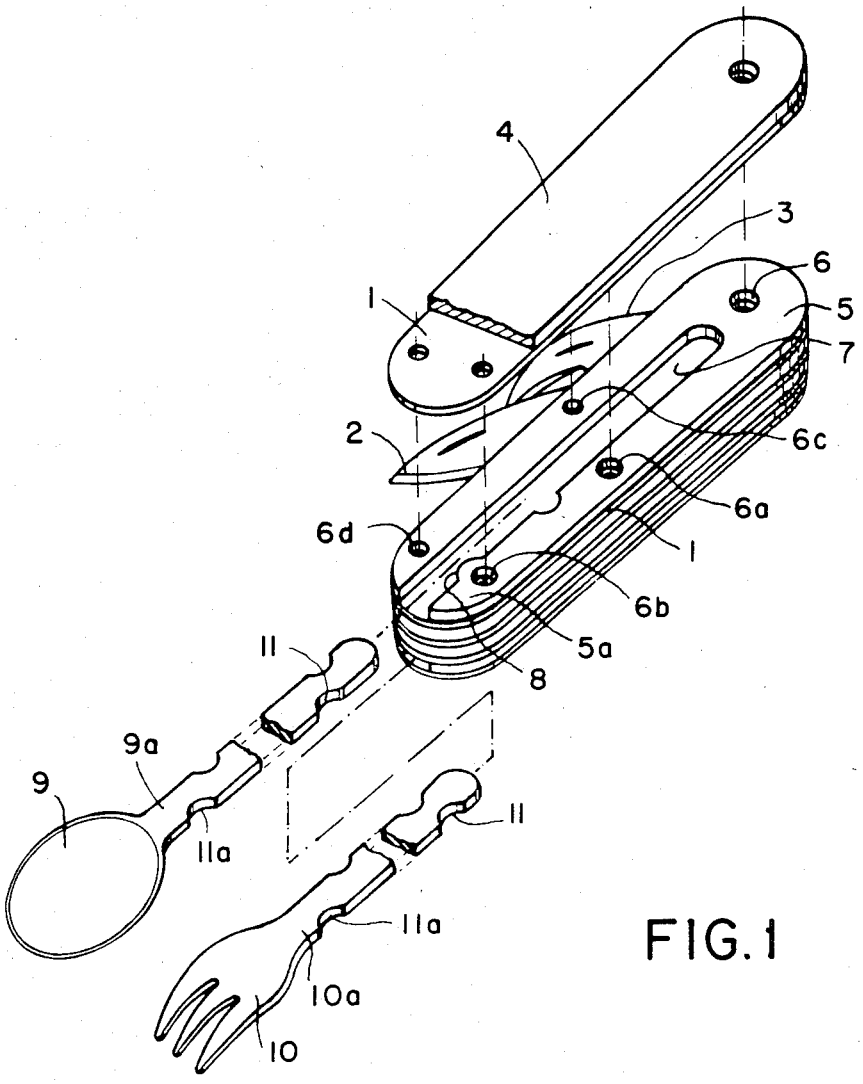
FIG. 1 is a perspective of this invention.
Figure 2:
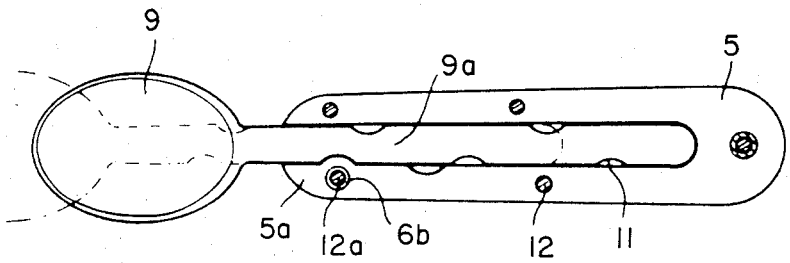
FIG. 2 is a plan view showing a state in which the spoon is installed.
Figure 3:
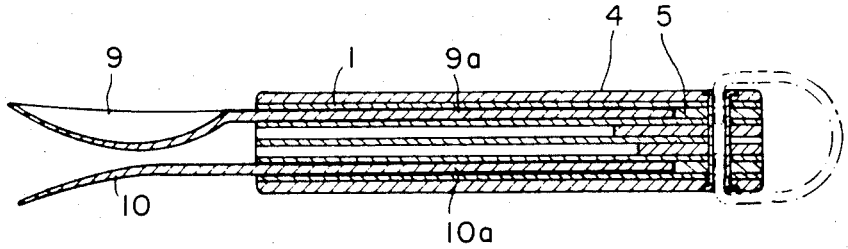
FIG. 3 is a vertical cross-sectional view.

In the normal case the portable knife includes a knife 2 and a can opener 3 axially installed among several plates 1 and with a cover 4 attached to both sides. One or more plate decks 5 with a longitudinally bored center are inserted among the plates 1.

The plate decks 5 are combined with the plates 1 by rivets in the combining holes 6, 6*a*, 6*b*, 6*c*, 6*d*. The combining hole 6*b*, formed on the free end 5*a* of the plate deck is larger in diameter than rivet 12*a* for elastic outward movement of the end 5*a* the center of the free end.

A projection 8 is formed on the end 5*a* in the pocket 7.

The grips 9*a*, 10*a* of the spoon 9 and fork 10 are so formed as to correspond to the pocket 7 and grooves 11, 11*a* are formed for receiving projection 8.

When the grip 9*a*, 10*a* of the spoon 9 or the fork 10 is inserted into the pocket 7 of plate deck 5, the free end 5*a* of plate deck 5 will widen outwardly and the spoon 9 or the fork 10 will be inserted therein. When the projection 8 and the grooves 11, 11*a* are well-fitted, either the spoon 9 or the fork 10 can not be pulled out nor inserted therein.

Thus, this device, which makes it possible to insert in or pull out the spoon 9 or the fork 10, is more convenient when used, because the spoon 9 and the fork 10 are not only located on one side of the grip but are also small in size and sightly in shape as they are not laid to overlap each other and because the spoon 9 or the fork 10 can be completely taken out when necessary.

I claim:

1. A portable knife, comprising:

a plurality of elongated plates extending in a longitudinal direction;

means for joining the plurality of elongated plates together into a layered assembly in which the individual plates are co-extensive, at least one of said plates including a pair of elongated, parallel legs extending in the longitudinal direction which define a pocket between them open at one end, one of said legs being displaceable transversely to the longitudinal direction;

a knife pivotably mounted at one end of the assembly; and a utensile including an elongated portion which is received through the open end of said pocket, longitudinally into said pocket and retained therein, said displaceable leg being displaceable transversely outwardly from the assembly to receive said elongated portion.

2. The portable knife as defined in claim 1, wherein the transversely displaceable leg includes a projection at the open end which projects into the pocket, and wherein the elongated portion of the utensile includes a groove dimensioned to receive said projection.

3. The portable knife as defined in claim 2, wherein the transversely displaceable leg further includes a hole adjacent to the projection for receiving the joining means with play to thereby permit the transverse displacement of said transversely displaceable leg.

4. The portable knife as defined in claim 3, wherein two of said plates include a pair of elongated, parallel legs extending in the longitudinal direction each of which defines a pocket between them open at one end, one of said legs of each plate being displaceable transversely to the longitudinal direction, and wherein two utensiles are provided each with an elongated portion received in a respective one of the pockets, said utensiles comprising a spoon and fork.

5. The portable knife as defined in claim 4, wherein the plates are provided with holes which are aligned and define a bore in assembly, and wherein the means for joining the plates comprises rivets received within said bores.

6. The portable knife as defined in claim 5, wherein the hole adjacent the projection is larger in diameter than the diameter of the rivet received therein resulting in said play.

* * * * *